United States Patent [19]

Ukegawa et al.

[11] Patent Number: 5,002,655

[45] Date of Patent: Mar. 26, 1991

[54] PROCESS FOR THE RECOVERY OF AROMATIC NITROGEN-CONTAINING COMPOUNDS

[75] Inventors: Koji Ukegawa, Tsukuba; Teruo Kondo, Tsuchiura; Akimitsu Matsumura, Noda; Kazumasa Yazu, Tsukuba, all of Japan

[73] Assignee: Director-General of Agency of Industrial Science and Technology, Japan

[21] Appl. No.: 323,827

[22] Filed: Mar. 15, 1989

[30] Foreign Application Priority Data

May 24, 1988 [JP] Japan ..... 63-126326

[51] Int. Cl.[5] ..... C10G 17/04

[52] U.S. Cl. ..... 208/254 R; 208/45; 208/304; 208/290

[58] Field of Search ..... 208/45, 254 R, 309, 208/290

[56] References Cited

U.S. PATENT DOCUMENTS

| | | | |
|---|---|---|---|
| 2,720.526 | 10/1955 | Sweeny | 208/254 |
| 2,955,079 | 10/1960 | Foley | 208/45 |
| 3,079,326 | 2/1963 | Neuworth | 208/45 |
| 3,153,626 | 10/1964 | Kulik | 208/45 |
| 4,272,362 | 6/1981 | Schneider et al. | 208/254 H |
| 4,324,651 | 4/1982 | Rollmann et al. | 208/45 |
| 4,353,792 | 10/1982 | Schneider et al. | 208/254 H |
| 4,592,831 | 6/1986 | Rhoe et al. | 208/45 |

FOREIGN PATENT DOCUMENTS

| | | | |
|---|---|---|---|
| 1653259 | 12/1962 | Canada | 208/45 |

*Primary Examiner*—Helane Myers
*Attorney, Agent, or Firm*—Lorusso & Loud

[57] ABSTRACT

A process for the recovery of aromatic nitrogen-containing compounds from an oily substance is disclosed which comprises extracting an oily substance containing aromatic nitrogen-containing compounds with a solvent containing water and a lower alkanol.

6 Claims, 1 Drawing Sheet

PROCESS FOR THE RECOVERY OF AROMATIC NITROGEN-CONTAINING COMPOUNDS

BACKGROUND OF THE INVENTION

1. Field of the Invention:

The present invention relates to a process for the recovery of aromatic nitrogen-containing compounds from an oily substance. More particularly, the present invention relates to a process for the recovery of aromatic nitrogen-containing compounds such as indole and the like aromatic amines from an oily substance such as coal tar by extracting the oily substance with a specific solvent.

2. Description of the Prior Art:

From the past, coal tar and residual oils obtained in thermal cracking of petroleum are known to be an oily substance containing aromatic nitrogen-containing compounds such as indole, quinoline and the like heterocyclic tertiary bases. Thus, various methods have been proposed hitherto as a means for separating such aromatic nitrogen-containing compounds from the oily substances. A typical method includes the steps of bringing an oily substance containing such aromatic nitrogen-containing compounds such as indole into contact with an acid to form a salt, for example, an oligmer salt in case of indole, and then subjecting the oligomer salt to thermal decomposition (Japanese Patent Appln. No. Sho. 62-249967). Another typical method comprises reacting indole in an oily substance with a caustic alkali to separate the indole as an alakaline salt thereof from the oily substance and then hydrolyzing the salt to convert it into indole ("Coal tar" Vol. 3, PP.189–194). However, these prior art methods wherein the aromatic nitrogen-containing compounds are first converted into salt form for separating them from the oily substance and the salts are then reconverted into the original compounds have drawbacks in that the steps and operations for the recovery of the compounds are complicated and the cost thereof is rather high.

Aromatic nitrogen-containing compounds such as indole, quinoline, isoquinoline, acridine, pyridine, picoline, lutidine and collidine are important as solvents or starting materials for producing medicines, agricultural agents and other type industrial products. In general, however, coal tar and the like oily substances are low in such aromatic nitrogen-containing compounds. Thus, the processes for recovering the compounds involve difficult operations which make these prior art methods economically unattractive.

Under the circumstances above mentioned, there is a great demand for developing a new method for the recovery of such useful aromatic nitrogen-containing compounds in an efficient manner from an oily substance lean in such compounds.

BRIEF SUMMARY OF THE INVENTION

Accordingly, it is an object of the present invention to provide a new method for the recovery of aromatic nitrogen-containing compounds from an oily substance containing them wherein disadvantages in operations and cost seen in the prior art methods are entirely overcome.

It is another object of the present invention to provide a process for the recovery of aromatic nitrogen-containing compounds from an oily substance in an efficient manner wherein the oily substance is extracted with a specific solvent system.

It is still another object of the present invention to provide an economical process for the recovery of aromatic nitrogen-containing compounds at a high recovery rate and selectivity from an oily substance in a simple operation.

Other objects, features and advantages of the present invention will become apparent more fully from the following description.

BRIEF DESCRIPTION OF THE DRAWING

The accompanying drawing.

DETAILED DESCRIPTION OF THE INVENTION

Figure 1:
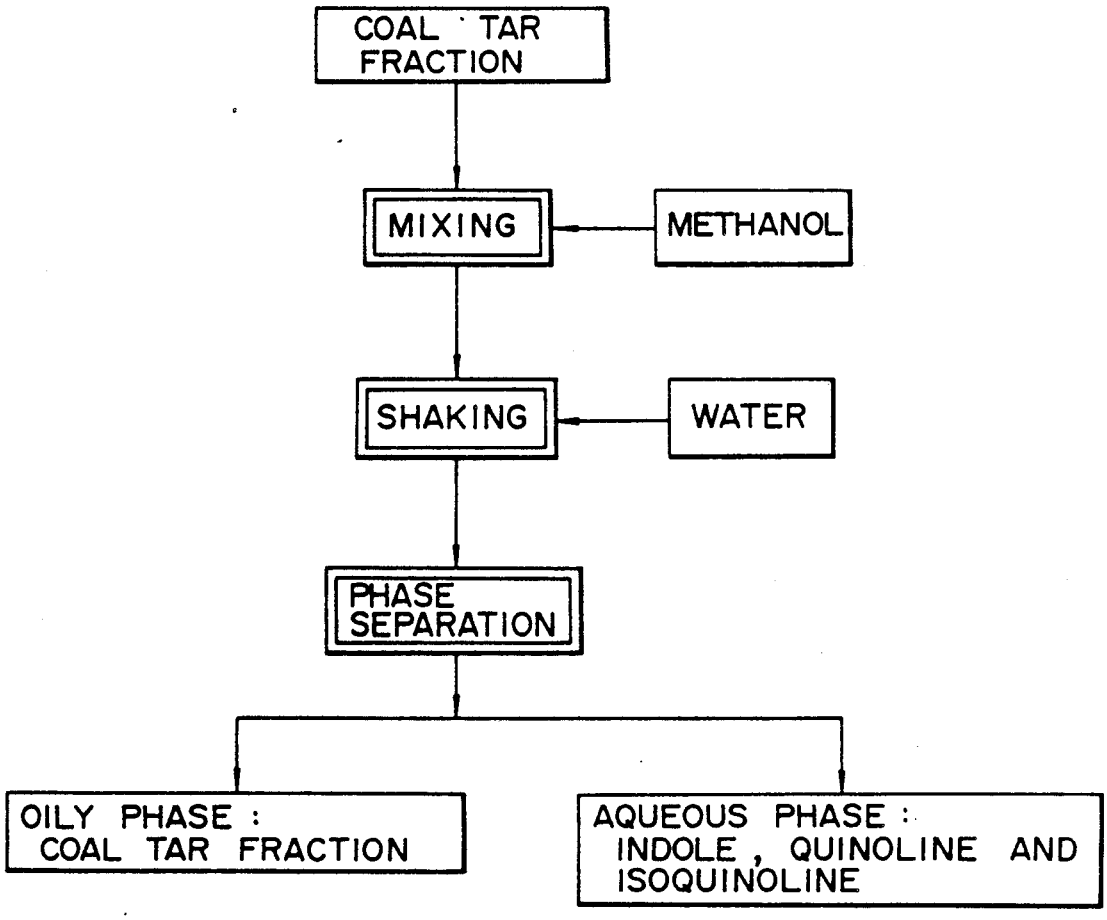
FIG. 1, is a diagram explaining the steps for the recovery of aromatic nitrogen-containing compounds from the oily substance according to the process of this invention.

As a result of extensive research made by the present inventors for developing a new simple and economical method for the recovery of aromatic nitrogen-containing compounds from coal tar or the like oily substance containing such compounds at a relatively low concentration, it has now been found surprisingly that when a lower alkanol such as methanol is added to the oily substance such as coal tar and then the mixture is brought into contact with water, the aromatic nitrogen-containing compounds migrate together with the lower alkanol into the water whereby the aromatic nitrogen-containing compounds are effectively separated and recoverd from the oily substance at high recovery rate and selectivity.

In accordance with the present invention, there is provided a process for the recovery of aromatic nitrogen-containing compounds from an oily substance containing such compounds, which comprises extracting an oily substance containing aromatic nitrogen-containing compounds with a solvent system comprised of water and a lower alkanol.

The present invention uses a specific solvent system for separating and recovering the aromatic nitrogen containing compounds from the oily substance, specifically the solvent system contains water and a lower alkanol miscible therewith.

The present invention is also distinguished by the use of the solvent system in an order of succession wherein the lower alkanol is first added to the oily substance and the mixture is then brought into contact with water thereby allowing the aromatic nitrogen-containing compounds and the alkanol to migrate into the water phase.

By the term "the aromatic nitrogen-containing compounds" is meant herein aromatic tertiary bases, or in other words, hetero cyclic compounds of aromatic nature containing ring nitrogen atom or atoms. Accordingly, such aromatic nitrogen-containing compounds as carry amino nitrogen atom or atoms attached to their aromatic ring, for example, aniline, naphthylamine and the like aromatic compounds having a primary or secondary amino group or groups are not intended to be included in the term "the aromatic nitrogen-containing compounds" as used herein. Thus, commercially available oily substances containing such aromatic nitrogen-containing compounds are, for example, coal tar, a coal tar-absorbed oil fraction, shale oil, a liquefied coal oil and a residual oil from thermal cracking of petroleum, among which coal tar or a coal tar-absorbed oil fraction is preferable as the oily substance to be treated. Several kinds of the aromatic nitrogen-containing compounds are contained in these oily substances usually in an amount less than 10% by weight.

The solvent system used in the present invention for extracting the aromatic nitrogen-containing compounds from the oily substance comprises a lower alkanol and water, and is normally used stepwise; a lower alkanol at the first stage and water at the second stage. In general, the lower alkanol is miscible with or fairly soluble in water and has 1–4 carbon atoms in its molecule. The alkyl moiety of the lower alkanol with 3–4 carbon atoms is generally linear but may be branched. Illustrative of the lower alkanol are, for example, methanol, ethanol, n-propanol, isopropanol, n-butanol, isobutanol and tert-butanol. The use of methanol and/or ethanol is preferable in the present invention. The proportion of the lower alkanol to the oily substance to be treated is usually within the range of 0.05–5, preferably 0.3–2. The proportion of water to the oily substance is usually within the range of 0.05–5, preferably 0.3–2. These proportions are all on weight basis.

The oily substance should be soluble in the lower alkanol to form a homogeneous solution. A coal tar fraction and a coal tar-absorbed oil fraction are very soluble in the lower alkanol.

The process of this invention will now be explained with reference to the explanatory diagram (flow sheet) shown in FIG. 1 wherein the individual steps are shown in double frames and are described by way of example, as using coal tar fraction as the oily substance and methanol as the lower alkanol.

In a proper mixing tank, a coal tar fraction is mixed with methanol by means of a proper mixer. The coal tar fraction is completely dissolved to form a homogeneous solution. Water is then added to the solution and the mixture is well shaken for a given period of time and allowed to stand whereupon the aqueous phase containing the aromatic nitrogen-containing compounds and methanol is separated from the oily phase. The desired aromatic nitrogen-containing compounds can be recovered by separating the aqueous phase from the oily phase and evaporating methanol and water. The individual aromatic nitrogen-containing compounds obtained as a residual oil can be separated by fractional distillation under reduced pressure.

In this process, methanol and water are used, as mentioned above, each in an amount of 0.05–5 times as much as the amount of the coal tar fraction. The extraction treatment of the coal tar fraction with methanol-water may be carried out under normal or superatmospheric pressure at a temperature from 0° C. to 100° C. The treatment is preferably carried out at normal temperature and pressure.

When the lower alkanol is added to the oily substance, a hydrogen bond is formed between the alkanol and the aromatic nitrogen-containing compounds. When water is added to the mixture of the alkanol and the oily substance, the alkanol migrates into the water phase whereby the aromatic nitrogen-containing compounds forming the hydrogen bond to the alkanol also migrates into the water phase. Thus, the aromatic nitrogen-containing compounds can effectively be extracted with the solvent system of the present invention. If the amount of the alkanol compound used is larger, the extraction rate of the aromatic nitrogen-containing compounds will correspondingly be increased but selectivity for the desired compounds will be decreased.

In another embodiment of the process of this invention, the lower alkanol may be added together with water to the oily substance. The extraction of the aromatic nitrogen-containing compounds can also be carried out equivalently with such solvent system but the extraction rate of the compounds tends to decrease. In most of the cases, therefore, it is desirable to use the lower alkanol at the first stage for capturing the aromatic nitrogen-containing compounds contained in the oily substance and then water at the second stage for migrating thereinto the lower alkanol combined with the aromatic nitrogen-containing compounds by hydrogen bond.

According to the process of this invention, the aromatic nitrogen-containing compounds can effectively be extracted from the oily substance at an extraction rate (yield) as high as 80% and also at a high selectivity, irrespective of whether the concentration of the aromatic nitrogen-containing compounds in the oily substance is high or low. It is indeed surprising that indole, quinoline and isoquinoline can be separated with a total selectivity of 80% or more. It is also a great advantage of the process of this invention that industrially useful aromatic nitrogen-containing compounds such as indole, quinoline and pyridine of a high concentration can be extracted and separated from commercially cheap oily substances such as coal tar by a simple and economical treatment at ambient temperature under atmospheric pressure. The aromatic nitrogen-containing compounds thus recovered can be concentrated and purified according to a known conventional manner to obtain pure products of a high concentration.

The present invention will now be illustrated in more detail by way of examples. In these examples, the extraction treatment was carried out according to the steps as shown in the flow sheet of FIG. 1 and described hereinbefore. The percentages used in these examples are by weight.

EXAMPLE 1

To 100 volumes of a coal tar-absorbed oil fraction containing 1.4 % of indole, 1.4 % of quinoline and 0.7 % of isoquinoline was added 200 volumes of methanol, and the mixture was stirred to form a homogeneous solution. To the solution was added 200 volumes of water. Then, indole, quinoline and isoquinoline were extracted with methanol and migrated together with the methanol into the aqueous phase. The aqueous phase was separated from the oily phase and worked up in a manner as described with respect to the flow sheet of FIG. 1. The extraction rates and selectivities of indole, quinoline and isoquinoline are as follows:

Extraction rates: indole 47%, quinoline 29% and isoquinoline 46%

Selectivity: indole 38%, quinoline 29% and isoquinoline 13% (total 80.9%).

EXAMPLE 2

To 100 volumes of a coal tar-absorbed oil fraction containing 1.4% of indole, 1.4% of quinoline and 0.7% of isoquinoline was added 500 volumes of methanol, and the mixture was stirred to form a homogeneous solution. To the solution was added 200 volumes of water. Then, indole, quinoline and isoquinoline were extracted with methanol and migrated together with the methanol into the aqueous phase. The aqueous phase was separated from the oily phase and worked up in a manner as described with respect to the flow sheet of FIG.

1. The extraction rates and selectivities of indole, quinoline and isoquinoline are as follows:

Extraction rates: indole 80%, quinoline 80% and isoquinoline 81%

Selectivities: indole 13%, quinoline 5% and isoquinoline 9% (total 26.8%).

It is understood that the preceeding representative examples may be varied within the scope of the present specification, both as to the extracting agents and conditions, by one skilled in the art to achieve essentially the same results.

As many apparently widely different embodiments of the present invention may be made without departing from the spirit and scope thereof, it is to be construed that the present invention is not limited to the foregoing specific embodiments.

What is claimed is:

1. A process for the recovery of heterocyclic compounds containing ring nitrogen atom or atoms from an oily substance containing same, said process comprising:

providing an oily substance selected from the group consisting of coal tars, residual oils obtained from the thermal cracking of petroleum, coal tar-absorbed oil fractions, shale oils and liquefied coal oils, said oily substance containing the heterocyclic compounds to be recovered;

first mixing said oily substance with a lower alkanol miscible with water to capture the heterocyclic compounds by the formation of hydrogen bond between the alkanol and the heterocyclic compounds and then mixing the oily substance with water whereby the thus bound heterocyclic compounds migrate into the aqueous phase; and separating and recovering said heterocyclic compounds from said aqueous phase.

2. The process of claim 1, wherein said separating and recovery is by evaporation of water and lower alkanol from said aqueous phase.

3. The process of claim 1, additionally comprising separating the recovered heterocyclic compounds by fractional distillation.

4. The process of claim 1, wherein the heterocyclic compounds are members selected from the group consisting of indole, quinoline, isoquinoline, pyridine, picoline, lutidine, collidine and mixtures thereof.

5. The process of claim 1, wherein said lower alkanol is linear or branched and has 1–4 carbon atoms.

6. The process of claim 1, wherein said lower alkanol is a member selected from the group consisting of methanol, ethanol, n-propanol, isopropanol, n-butanol, isobutanol and tert-butanol.

* * * * *